United States Patent [19]

Washio et al.

[11] 4,017,175

[45] Apr. 12, 1977

[54] APPARATUS FOR PREVENTING SUCCESSIVE JAMMING OF COPY SHEETS IN COPYING APPARATUS

[75] Inventors: Takaji Washio, Toyonaka; Tatsuo Aizawa, Osaka, both of Japan

[73] Assignee: Mita Industrial Company, Ltd., Osaka, Japan

[22] Filed: Apr. 17, 1973

[21] Appl. No.: 351,977

Related U.S. Application Data

[63] Continuation of Ser. No. 164,779, July 21, 1971, abandoned.

[30] Foreign Application Priority Data

July 21, 1970 Japan ..... 45-63211

[52] U.S. Cl. ..... 355/14; 355/50; 355/64

[51] Int. Cl. ..... G03g 15/22

[58] Field of Search ..... 355/50, 51, 13, 14, 355/29, 64; 271/57

[56] References Cited

UNITED STATES PATENTS

| | | | |
|---|---|---|---|
| 3,181,420 | 5/1965 | Rautbord | 355/14 |
| 3,545,742 | 12/1970 | Muller | 271/57 X |
| 3,549,255 | 12/1970 | Umahashi et al. | 271/57 X |
| 3,592,540 | 7/1971 | Cransken | 355/14 |
| 3,604,796 | 9/1971 | Ogawa | 355/14 |
| 3,637,305 | 1/1972 | Tanaka | 355/29 X |

*Primary Examiner*—Samuel S. Matthews
*Assistant Examiner*—E. M. O'Connor
*Attorney, Agent, or Firm*—Sherman & Shalloway

[57] ABSTRACT

Apparatus for preventing successive jamming of copy sheets in copying apparatus of the type including a forwarding mechanism for moving a copy sheet along a running path through a treatment zone for forming a visible image on the copy sheets and a copy sheet feeding mechanism, the successive jamming prevention apparatus including one or more detecting members disposed at detecting points in the running path so that at least one of the detecting members will contact a copy sheet at any position in the running path, a switch having normally closed contacts opened in response to contact of any of the detecting members with a copy sheet to prevent actuation of the copy sheet feeding mechanism and normally open contacts closed in response to contact of any of the detecting members with a copy sheet to provide an alarm signal.

7 Claims, 12 Drawing Figures

Fig. 1
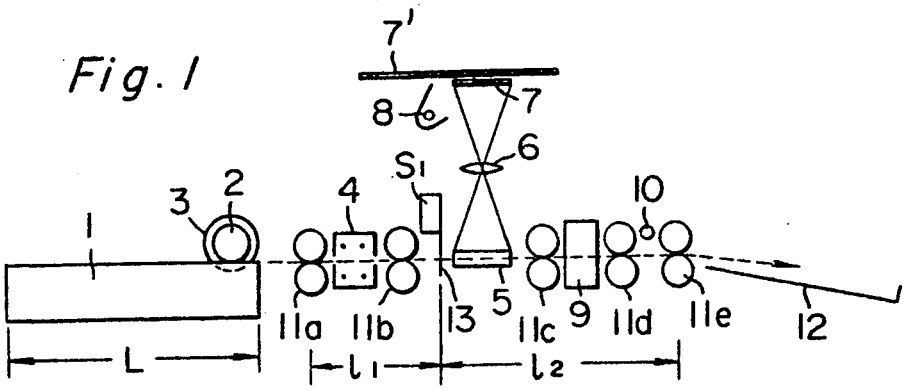
Fig. 2-a
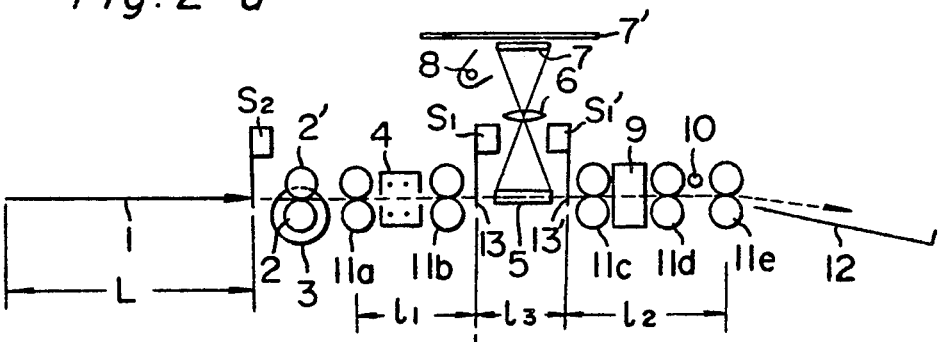
Fig. 2-b
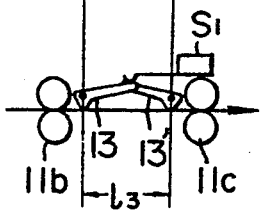

Fig. 2-c
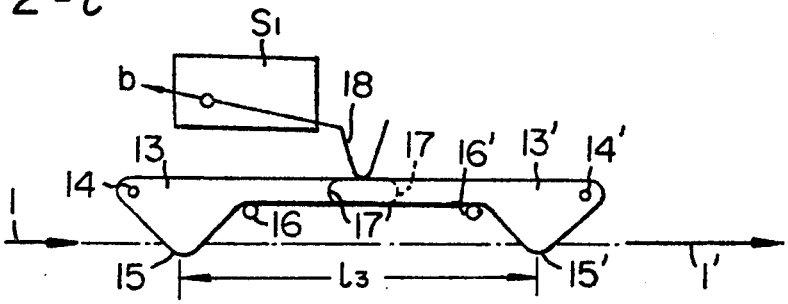
Fig. 2-d
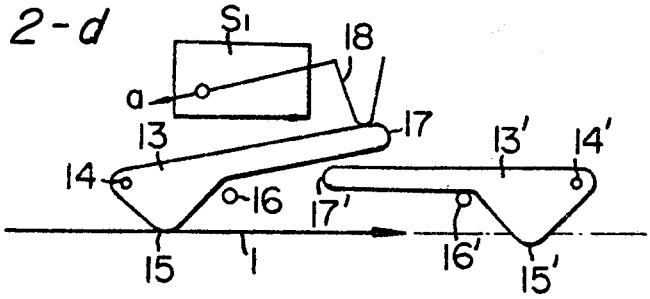
Fig. 2-e
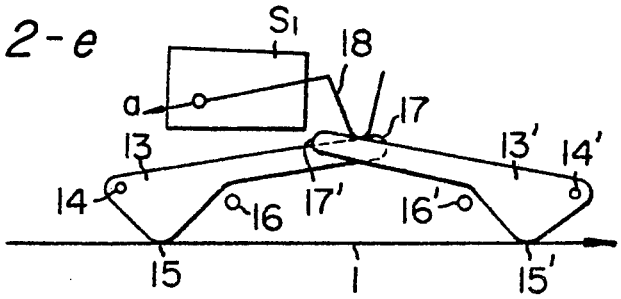
Fig. 2-f
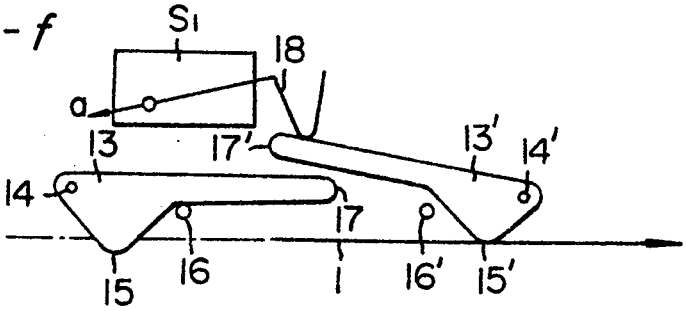

APPARATUS FOR PREVENTING SUCCESSIVE JAMMING OF COPY SHEETS IN COPYING APPARATUS

This application is a continuation of copending patent application Ser. No. 164,779 filed July 21, 1971, now abandoned.

BACKGROUND OF THE INVENTION

Field of the Invention

This invention relates to copying apparatus in which successive jamming of copy sheets is prevented and an alarm signal is provided when a copy sheet is jammed in the apparatus. More specifically, this invention relates to copying apparatus in which, in case a copy sheet is jammed in a running path of the copying apparatus, an alarm signal is provided and a copy sheet feeding mechanism for feeding the copy sheets to the running path is not actuated such that a subsequent copy sheet is not delivered whereby successive jamming of copy sheets is prevented.

Technical Consideration and Prior Art

Generally, a copying apparatus includes a treatment zone for forming a visible image on a copy sheet and mechanism for forwarding the copy sheet to the treatment zone. For instance, in the case of an electrophotographic copying apparatus, a copy sheet having a photoconductive layer is forwarded by a suitable forwarding mechanism to a charging zone and a light-exposing zone where an electrostatic image is formed on the copy sheet, and the copy sheet bearing the electrostatic image is forwarded to a developing mechanism where the image is developed by colored toner particles. If required, the copy sheet is forwarded to a fixing mechanism in which the toner particles are fixed on the photoconductive layer of the copy sheet.

In such electrophotographic copying apparatus, copy sheets tend to stick in the running path in the apparatus under influence of the electrostatic charge on the copy sheets or under influence of a coating layer formed on the copy sheets or action of a developer, and such sticking results in undesired jamming of copy sheets in the running path. Occurrence of such jamming of copy sheets is greatly influenced by delicate changes in the humidity or temperature of the ambient atmosphere. Accordingly, it is very difficult to completely prevent jamming of copy sheets in the running path.

In the art of electrophotography, devices have been proposed for detecting jamming of copy sheets in the copying apparatus. For instance, a known Xerographic copying apparatus includes a member for transmitting one pulse per feeding of a copy sheet; a programming device provided with a counter actuated by the pulse-transmitting member to sum the number of copy sheets; a register; a pulse-receiving member for actuating the register in response to an input pulse; and a member for operationally connecting the counter and pulse-receiving member in accordance with a multiplex program.

The above copying apparatus is advantageous in that jamming of copy sheets can be detected while a plurality of copy sheets are forwarded to the treatment zone coincidentally. However, the electric circuits utilized are extremely complicated, and a complicated detecting mechanism such as this is unfit for a copying apparatus of a type in which one copy sheet is supplied per one copying treatment.

SUMMARY OF THE INVENTION

The primary object of this invention is to provide a copying apparatus of a type in which one copy sheet is supplied per one copying treatment, wherein a copy sheet feeding mechanism is not actuated while a copy sheet is present in the treatment zone and the discharge of the copy sheet has not been completed whereby successive jamming of copy sheets can be effectively prevented and an alarm signal is provided if a copy sheet remains in the treatment zone after a reciprocating support for the original to be copied is returned to a central position.

The present invention is generally characterized in electrophotographic copying apparatus including a treatment zone for forming a visible image on a copy sheet formed of a charging zone, a light-exposing zone, a developing zone and a drying zone, a forwarding mechanism for moving a copy sheet along a running path through the treatment zone from an initial nip to a discharge end, a copy sheet feeding mechanism for delivering single copy sheets to the initial nip of the forwarding mechanism, an original support for reciprocating an original to be copied right and left from a central position in synchronism with movement of the copy sheet and returning the original to the central position, and an optical system for forming a light image corresponding to an image of the original on a photoconductive layer of the copy sheet at the light-exposing zone, the improvement comprising actuating means controlling the copy sheet feeding mechanism; first switch means having normally closed contacts connecting the actuating means with a source of electricity and normally open contacts; detecting means for detecting a copy sheet in the running path at least at one detecting point and controlling the first switch means to open the normally closed contacts and close the normally open contacts when a copy sheet is detected at the detecting point, the detecting point being positioned in the running path to satisfy the following conditions:

$$l_1 < L$$

$$l_2 < L$$

where L is the minimum length of a copy sheet, $l_1$ is the distance between the initial nip of the forwarding mechanism and the detecting point, and $l_2$ is the distance between the detecting point and the discharge end of the forwarding mechanism; second switch means closed only when the original support is stationary at the central position; and alarm means connected with the source of electricity through the second switch means and the normally open contacts of the first switch means, the alarm means being energized to provide an alarm signal when the original support returns to the central position to close the second switch means if a copy sheet is detected at the detecting point to close the normally open contacts of the first switch means.

The device of this application can be applied to copying machines of various types. For instance, the device of this invention is particularly preferably applied to an electrophotographic machine in which a photosensitive copy sheet having a photoconductive layer is passed successively through a charging zone, a light-exposing zone, a developing zone and a drying or fixing zone. In addition, the device of this invention is adaptable to other copying machines of various types; for example, a copying machine in which a copy sheet is forwarded onto a photoconductive layer or a laminated photosensitive layer comprising an electroconductive layer, a photoconductive layer and an insulating layer to thereby effect (i) the image transferring and the fixation or (ii) the electrostatic transferring, the development and the fixation; a diazo-type copying machine of a dry, wet or hot type where a diazo-type copy sheet is exposed to light to form a latent image and then development is effected; and a Thermofax copying machine.

BRIEF DESCRIPTION OF THE DRAWINGS

This invention will now be detailed specifically by referring to accompanying drawings. In the drawings, in order to avoid repetition of explanation, elements having the same function are designated by the same reference numbers.

FIG. 1 is a diagram showing the arrangement of an embodiment of this invention applied to an electrophotographic copying machine of a type in which copy sheets are fed automatically;

FIG. 2*a* is a diagram showing the arrangement of another embodiment of this invention applied to an electrophotographic copying machine in which photosensitive copy sheets are fed manually;

FIG. 2*b* is a diagram showing the arrangement of still another embodiment of this invention where a detecting member different from that illustrated in FIG. 2*a* is applied to the copying machine shown in FIG. 2*a;*

FIGS. 2*c*, 2*d*, 2*e* and 2*f* are diagrams illustrating the actuation and operation of the detecting member and switch mechanism illustrated in FIG. 2*b*.

DESCRIPTION OF THE PREFERRED EMBODIMENT

Figure 3:
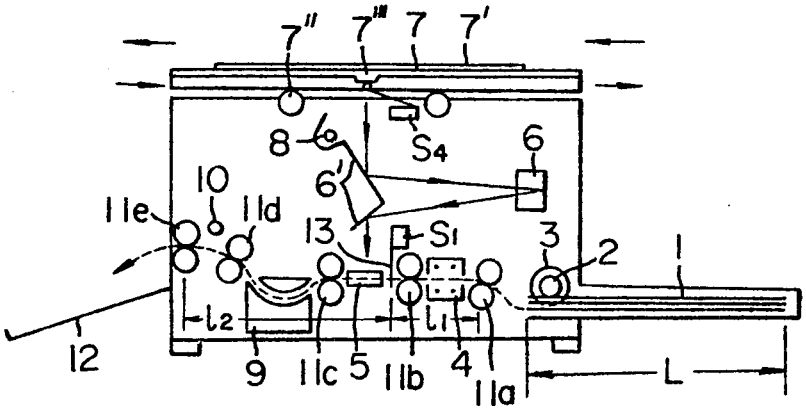
FIG. 3 is a diagram showing the arrangement of still another embodiment of this invention applied to an electrophotographic copying machine.

In FIG. 1, illustrating an embodiment where this invention is applied to an electrophotographic copying machine of a type in which copy sheets are fed automatically, a pack 1 of copy sheets is provided on the copy sheet feed side of a running path through the copying apparatus, and a copy sheet feeding mechanism comprising a feed roll 2 rotated intermittently by means of a feed clutch 3 is arranged at the top end portion of the pack 1. The feed roll 2 is mounted on a machine frame in a manner such that when the copying is conducted under normal operation, it will be in pressing contact with a copy sheet. A running path through the copying apparatus includes a group of rolls 11*a*, 11*b*, 11*c*, 11*d* and 11*e*. Along the running path composed of continuously driven rolls 11*a* to 11*e*, there are arranged successively zones for treating the copy sheet. More specifically, a charging mechanism, for example, a corona discharge member 4 is disposed between rolls 11*a* and 11*b*, and a zone for exposing the copy sheet to light is arranged between rolls 11*b* and 11*c*. An original 7′ on a transparent plate 7 for exposing the original to light is exposed to light from a light source 8, and an image of the original 7′ is transferred to a photoconductive layer of the copy sheet travelling between rolls 11*b* and 11*c* by means of an optical system comprising the transparent plate 7, a lens 6 and a transparent plate for exposing a copy sheet to light. Thus, there is formed an electrostatic image on the copy sheet. A developing zone 9 is disposed between rolls 11*c* and 11*d;* and, in the developing zone 9, the electrostatic image is converted to a visible image by a known developing mechanism, for instance, a dry or wet developing mechanism. A drying or fixing zone 10 is arranged between rolls 11*d* and 11*e* to dry the copy sheet or fix the toner image formed on the copy sheet. The drying or fixation is accomplished by means of a known mechanism such as an electric heater, an infrared lamp or a hot air feeding device.

Thus, the copy sheet is passed through the charging zone, the light-exposing zone, the developing zone and the drying or fixing zone successively in the direction indicated by the arrow in the drawings, and then is discharged in a copy receiver 12.

A copy sheet detecting member 13 is disposed in the running path of the continuously driven forwarding mechanism in the apparatus shown in FIG. 1. At the detecting member 13 there may be employed a switch detecting the arrival of the copy sheet by contacting the copy sheet or a photoelectric detecting mechanism including a light source and a light-detecting element. In short, any member that can be actuated by a copy sheet and kept in the actuated state during the passage of the copy sheet but returned to the original non-actuated state after passage of the copy sheet may be used as the detecting member 13 in the apparatus of this invention.

In case, as is illustrated in FIG. 1, a sole copy sheet detecting member 13 is provided in the running path of the continuously driven forwarding mechanism, it is particularly important that the following relation should be established for a minimum length L of copy sheets to be used in the copying apparatus, the distance $l_1$ between the first nip point of the continuously driven forwarding mechanism, the nip of rolls 11*a*, and the copy sheet detecting member, and the distance $l_2$ between the copy sheet detecting member, and the discharge end of the continuously driven forwarding mechanism:

$$l_1 < L \ (1):$$

$$l_2 < L \ (2).$$

In the embodiment shown in FIG. 1 when the copy sheet detecting member 13 is actuated, a switch $S_1$ is coincidentally actuated. The operation of controlling the copy sheet feeding mechanism so that jamming of copy sheets will be prevented is accomplished by a system including the electric circuits shown in FIG. 4 or FIG. 5.

Figure 4:
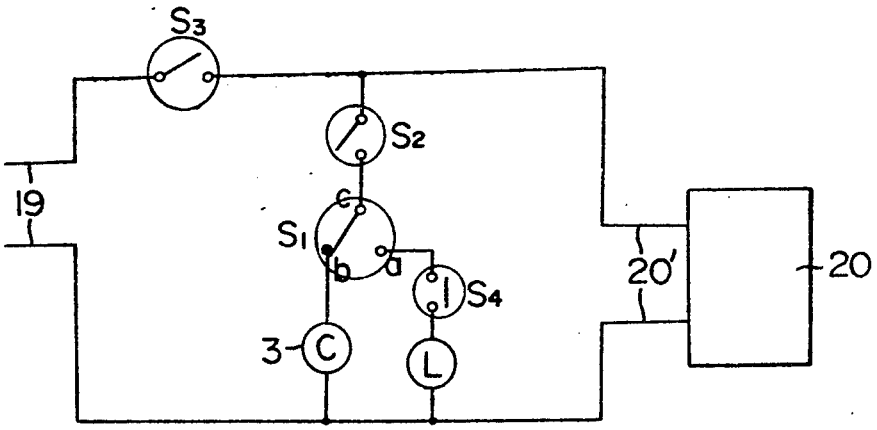
FIG. 4 is a circuit diagram of a normally closed switch mechanism adaptable to the apparatus of this invention.

With reference to FIG. 4, when the power is applied to 20′, rolls 11*a* to 11*e* of the continuously driven forwarding mechanism and each of the charging zone, the light-exposing zone, the fixing zone and other members of the copying apparatus 20 begin to operate, and only the operation of the copy sheet feeding mechanism is inhibited by means of a clutch.

In conducting the copying, the actuating switch $S_2$ is turned on and thus, the actuating means of the copy sheet feeding mechanism, for example, a solenoid C of an electromagnetic clutch 3, is connected with the power source 19 through the normally closed contacts (*c-b*) of the switch $S_1$. The clutch 3 is thus actuated and feel roll 2 is rotated, whereby a copy sheet is fed to the nip of rolls 11*a*. Thus, the copy sheet is fed into the running path of the copying apparatus; and, at the same time, the copy sheet contacts the copy sheet detecting member 13 to actuate the switch $S_1$ and open the normally closed contacts (*b-c*) while closing the normally open contacts (*c-a*). By the opening of the contacts (*b-c*) of the switch $S_1$, the clutch 3 is turned off and the feed roll 2 thus stops its operation while the copy sheet is being advanced through each treating zone by means of continuously rotating rolls 11*a* to 113. While the copy sheet is in the running path, the copy sheet detecting member 13 is held in the actuated state and, hence, the normally closed contacts (*c-b*) of the switch $S_1$ are kept open. After the transit of the copy sheet, the copy sheet detecting member 13 is returned to the original state and thus, the contacts (*c-b*) of the switch $S_1$ are closed again.

The copy sheet after passing through charging zone 4, light-exposing zone 5, developing zone 9 and fixing zone 10 by means of rolls 11*a* to 11*e*, is discharged into copy receiver 12 disposed on the discharge side of the forwarding mechanism. Thus, the copying of one copy sheet is completed. If the actuating switch $S_2$ is turned on again, the clutch 3 is actuated again and the roll 2 is rotated, with the result that the copying operation proceeds in the same manner as described above.

In case jamming of a copy sheet occurs in the running path of the apparatus, the copy sheet detecting member 13 remains in the actuated state and the normally closed contacts (*c-b*) of the switch $S_1$ remain open. Accordingly, even if the actuating switch $S_2$ is closed, the clutch 3 is not actuated; and, therefore, subsequent feeding of copy sheets is prevented.

The restoration of the apparatus to its operative condition is accomplished by opening the power switch $S_3$, withdrawing the copy sheet jammed in the apparatus and closing the input switch $S_3$ again. Thus, the normal operative condition is restored in the apparatus.

A lamp or other alarming member L is connected with the normally open contacts (*c-a*) of the switch $S_1$ through a switch $S_4$ which is closed only when a copy sheet is not travelling in the apparatus. Jamming of a copy sheet is indicated to energizing the alarming member L to provide an alarm signal.

In the embodiment shown in FIG. 1, it is possible to employ as the switch $S_1$ a normally open switch instead of the normally closed switch shown in FIG. 4. For example, in the embodiment illustrated in FIG. 5, the actuating means C of the clutch mechanism 3 for effecting the feeding of a copy sheet is connected with an electric power source through the normally closed contacts (*c-b*) of a relay $R_a$, an actuating switch $S_2$ and a power source switch $S_3$. One end of the coil R of the relay $R_a$ is connected with one terminal of electric power source 19, and the other end of coil R is adapted to be connected through the normally open contacts (*a-c*) of the switch $S_1$ actuated by the detecting member 13, with the power source switch $S_3$. When the power source switch $S_3$ and the actuating switch $S_2$ are closed, the actuating means C is energized through the normally closed contacts (*c-b*) of the relay $R_a$, and a copy sheet is fed to the running path of the continuously driven forwarding mechanism. When the copy sheet actuates the detecting member 13, the normally open contacts (*a-c*) of the switch $S_1$ are closed, and the coil R of relay $R_a$ is energized to open contacts (*c-b*) and closed contacts (*c-a*) thereof with the result that the actuating means C of the copy sheet feeding mechanism is deenergized. When the copy sheet has passed the position of the detecting member 13, the contacts (*a-c*) of the switch $S_1$ open and the coil R is deenergized to close the contacts (*b-c*) of the relay $R_a$. However, when the copy sheet is jammed in the running path of the continuously driven forwarding mechanism, the contacts (*b-c*) of the relay $R_a$ remain in the open state. Accordingly, even if the actuating switch $S_2$ is closed, the copy sheet feeding mechanism is not actuated; and, thus, successive jamming of copy sheets is avoided.

Various modifications of this invention are possible. For instance, a manual mechanism may be adopted for feeding copy sheets instead of an automatic feeding mechanism comprising an electromagnetic clutch and feed rolls as described above. It is also possible to dispose a plurality of detecting members in the copy sheet running path of the continuously driven forwarding mechanism.

FIG. 2*a* illustrates an embodiment where this invention is applied to an electrophotographic copying apparatus of a type where a copy sheet is fed manually. On the feed side of the continuously driven forwarding mechanism including rolls 11*e*, a pair of feed rolls 2, 2' are provided so that they will be intermittently rotated by an electromagnetic clutch 3, and on the feed side of the rolls 2, 2' there is disposed an actuating switch $S_2$. In the embodiment of FIG. 2*a*, a plurality of copy sheet detecting member 13, 13' . . . are arranged in the running path, and it is important that the following relation should be established for a minimum length L of copy sheets to be used, the distance $l_1$ between the first nip point of the continuously driven forwarding mechanism and the first detecting member, the distance $l_2$ between the last detecting member and the discharge end of the continuously driven forwarding mechanism, and the distance $l_3$ between every two neighboring detecting members:

$$l_1 < l$$

$$l_2 < L$$

$$l_3 < L$$

Figure 5:
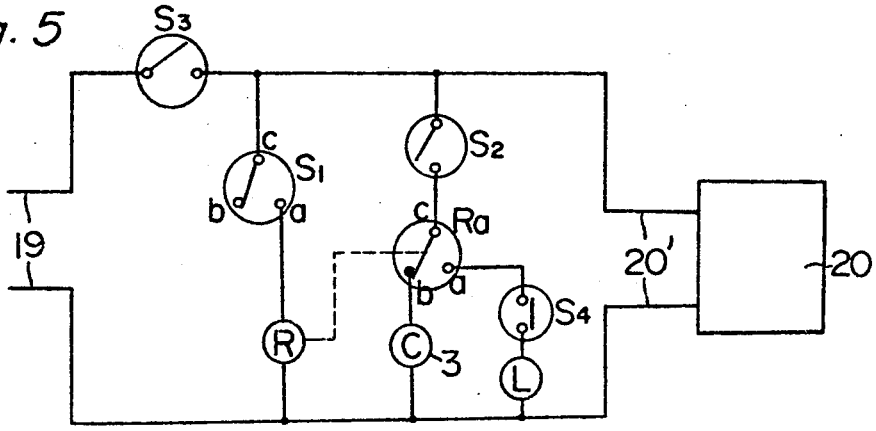
FIG. 5 is a circuit diagram of the switch mechanism of FIG. 4 in which relays adaptable to the device of this invention are employed.
Figure 6:
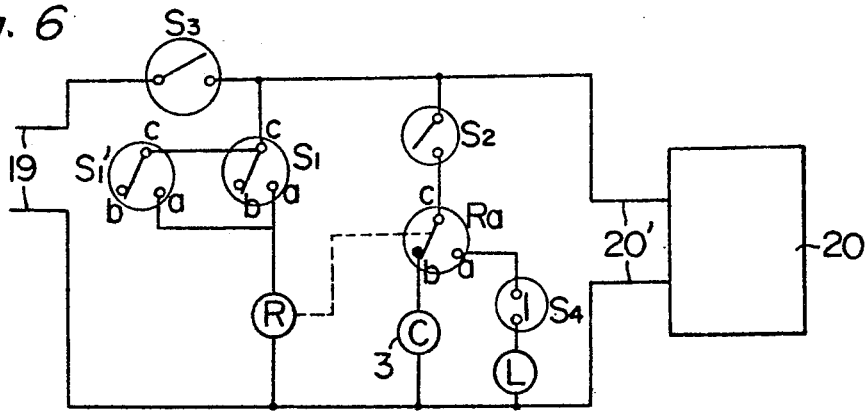
FIG. 6 is a circuit diagram of a modification of the switch mechanism of FIG. 5 in which a plurality of switches are connected in parallel.

The copy sheet detecting members 13, 13' . . . actuate normally open switches $S_1$, $S_1'$ . . . , respectively, connected in the circuit of FIG. 6 which is the same as the circuit of FIG. 5 except for the parallel connections of the plurality of switches $S_1$, $S_1'$ . . . .

In the embodiment of FIG. 2*a*, when a copy sheet is inserted between feed rolls 2 and 2', the actuating switch is closed, and electromagnetic clutch 3 (C) is energized via switches $S_3$ and $S_2$ and the normally closed contacts (*b-c*) of the relay $R_a$. Thus, the feed rolls 2, 2' are rotated and the copy sheet is nipped by the first pair of driving rolls 11*a* of the continuously driven forwarding mechanism and forwarded to each treating zone. When the copy sheet is advanced in the running path of the continuously driven forwarding mechanism, it actuates any or all of detecting members 13, 13' . . . and normally open contacts (*a-c*) of any or all of switches $S_1$, $S_1'$ . . . are closed to energize the coil R whereby the normally closed contacts (*b-c*) of relay $R_a$ are opened and actuating means C is deenergized. When the copy sheet has passed by all of the detecting members 13, 13' . . . and switches $S_1$, $S_1'$ . . . are all opened, the contacts (*b-c*) of the relay $R_a$ are closed and actuating means C can be energized again through switch $S_2$. If a copy sheet is jammed at any point in the running path of the continuously driven forwarding mechanism, the contacts (*c-b*) of one of the switches $S_1$, $S_1'$ . . . will remain closed; and, thus, contacts (*c-b*) of relay $R_a$ will remain open. Accordingly, even if the actuating switch $S_2$ is closed, the copy sheet feeding mechanism will not be actuated; and, therefore, successive jamming of copy sheets is prevented.

In the copying apparatus illustrated in FIG. 2*a*, it is possible to adopt a modification where a pair of forwarding rolls 11*a* are replaced by a pair of feed rolls 2, 2'. Further, it is possible to adopt another modification where instead of feed rolls 2, 2' provided with an electromagnetic clutch 3, there is used a screening plate projecting in the direction crossing the running path as the copy sheet feeding mechanism, and if jamming of a copy sheet is caused at any point of the running path, the copy sheet feeding passage is positively screened by the screening plate by actuating means C as described above.

In the above embodiment, a plurality of copy sheet detecting members are disposed to actuate corresponding normally closed switches, respectively, but it is possible to arrange a plurality of copy sheet detecting members 13, 13' . . . so as to actuate a single switch $S_1$. In this case, the operation is conducted in an order illustrated in FIG. 2*c*.

In FIG. 2*c*, a copy sheet detecting member 13 includes a lever portion 17, one end of which is rotatably mounted by a pivot 14 and the other end of which is in contact with a change-over plate 18 of a switch $S_1$. The detecting member 13 is provided at the lower end portion thereof with a smooth projection 15 adapted to contact a copy sheet. The change-over plate 18 of the switch $S_1$ is pressed downwardly by a suitable elastic member, and detecting members 13, 13' are supported by fixing pins 16, 16' so that projections 15, 15' of detecting members 13, 13' will cross the running path for a copy sheet (see FIG. 2*c*).

When a copy sheet 1 is fed into the running path, the sheet 1 contacts the projection 15 and lifts the lever portion 17 of the detecting member 13. Thus, the change-over plate 18 of the switch $S_1$ is pressed upwardly and the switch $S_1$ is actuated (see FIG. 2*d*). Then, the copy sheet contacts the projection 15' of the subsequent detector 13', and the lever portion 17' of the detector 13' is lifted (see FIG. 2*e*). When the rear end of the copy sheet is free from contact with the projection 15 of the detecting member 13, the lever portion 17 of the detecting member 13 is moved downwardly by its own weight or by means of the elastic member, whereby the contact between the lever portion 17 and the change-over plate 18 is interrupted. However, the change-over plate of the switch $S_1$ is still pressed upwardly by the lever portion 17' of the detecting member 13' (see FIG. 2*f*).

When the rear end of the copy sheet 1 is free from contact with the projection 15' of the detecting member 13', the state shown in FIG. 2*c* is restored, and switch $S_1$ is deactuated.

As explained above, when any one of the projections of the detecting members 13,13' . . . is in contact with a copy sheet, the copy sheet feeding mechanism cannot be actuated.

The combination of detecting members and the switch illustrated in FIG. 2*c* can be applied to the control systems shown in FIG. 4 or FIG. 5.

FIG. 3 illustrates more specifically an embodiment of this invention applied to an electrophotographic copying machine. A copy sheet contained in a sheet pack 1 is fed in the machine by a sheet-feeding machanism including a roll 2 intermittently rotated by a sheet feeding clutch 3, and it is forwarded to a charging zone 4, a light-exposing zone 5, a developing zone 9 and a drying zone 10 by the continuously driven forwarding mechanism including rotating rolls 11*a* to 11*e*, following which the copy sheet is withdrawn to a copy receiver 12. One or a plurality of copy sheet detecting members are disposed in the running path in the same manner as described hereinabove to detect the transit of the copy sheet.

An original 7' placed on an original support 7 is reciprocated right and left from the central position in synchronism with the advance of the copy sheet by a roll 7'' for driving the original support 7, and returned to the central position. Thus, one step is completed. During this step, while the original is moved into the left direction in FIG. 3, it is exposed to light emitted from a light source lamp 8 and the slit light scanning is conducted on the light-exposing zone 5 through an optical system including a mirror 6' and a lens 6. The switch $S_4$ is closed only when the original support 7 stands still in the central position and is connected in circuit as shown in FIG. 4.

Accordingly, if the copy sheet is not withdrawn from the discharge rolls 11*e* during one reciprocating movement of the original support 7, alarming member L will be connected to the source of electricity via switch $S_4$ and contacts (*c-a*) of switch $S_1$ in FIG. 4 or of relay $R_a$ in FIGS. 5 and 6 to provide an alarm signal.

Figure 7:
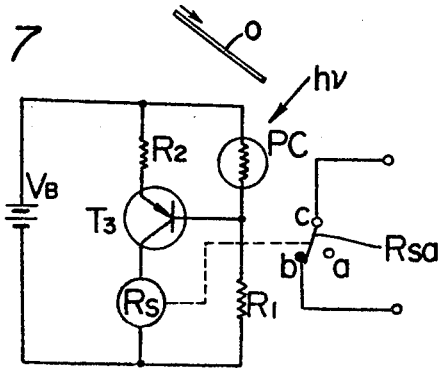
FIG. 7 is a circuit diagram of a detecting circuit in which light-detecting means are employed.

Instead of the detecting member being actuated by the mechanical pressing contact of a copy sheet, there may be employed a photoelectric detecting member as shown in FIG. 7. In FIG. 7, PC designates a photo-semiconductor such as CdS or phototransistor which is connected with the base of the transistor $T_3$ as well as a resistance $R_1$. The main current circuit from a power source $V_B$ is connected in series to a resistance $R_2$, the transistor $T_3$ and a relay Rs to form an amplification circuit.

A light hv is radiated to the photo-semiconductor PC, and in this state the resistance of the photo-semiconductor PC is reduced, the transistor $T_3$ is in the non-conductive state and the relay R*s* is not actuated. Accordingly, the contacts (*b-c*) of a relay R*sa* are closed. When the light hv radiated to PC is screened by a copy sheet O, the coil R*s* is actuated and the contacts (*b-c*) of the relay R*as* open.

This invention has been described only with reference to electrophotographic copying machines, but as is seen from the foregoing description, this invention may be applied to copying machines of a type where a copy sheet is fed through copying zones in the machine.

What is claimed is:

1. In an electrophotographic copying apparatus for producing images on copy sheets capable of being used in the apparatus, having a treatment zone including a charging means for charging a copy sheet, a light-exposing means having an optical system for projecting an image of an original to be copied on a charged copy sheet to form an electrostatic image on the copy sheet, a developing means for developing the exposed copy sheet thereby converting the electrostatic image to a visible image, a drying or fixing means for drying or fixing the image formed on the copy sheet, a forwarding mechanism for moving a copy sheet along a running path through the treatment zone from an initial nip to a discharge end, a copy sheet feeding mechanism for delivering single copy sheets to the initial nip of the forwarding mechanism, an original support for reciprocating the original laterally from a central position in synchronism with movement of the copy sheet and returning the original to the central position and a source of electricity, said copying apparatus comprising:

an activating means for controlling the copy sheet feeding mechanism;

first switch means having both a normally closed contact connecting said actuating means with a source of electricity and a normally open contact;

detecting means for detecting a copy sheet in the running path at least at one detecting point and controlling said first switch means to open said normally closed contact and close said normally open contact when a copy sheet is detected at said detecting point, said detecting point being positioned in the running path according to the following conditions:

$$l_1 < L$$

$$l_2 < L$$

where L is the minimum length of the copy sheets capable of being used in the apparatus, $l_1$ is the distance between the initial nip of the forwarding mechanism and said detecting point forwarding mechanism, and $l_2$ is the distance between said detecting point forwarding mechanism and the discharge end of the forwarding mechanism;

a second switch means closed only when the original support is stationary at the central position; and alarm means connected with the source of electricity through said second switch means and said normally open contact of said first switch means, said alarm means being energized to signal occurrence of jamming of the copy sheet if the copy sheet is jammed in the running path and detected at said detecting point and closes said normally open contact of said first switch means when the original support returns to the central position and closes said second switch means.

2. The improvement as recited in claim 1 wherein said detecting means comprises a normally open switch closed by contact with a copy sheet and a relay coil connected in series with said normally open switch, and said normally closed contact of said first switch means comprises a normally closed relay contact controlled by said relay coil whereby said normally closed relay contact is opened to deenergize said actuating means in response to energizing of said relay coil by closing said normally open switch.

3. The improvement as recited in claim 1 wherein said detecting means includes a source of light, photoelectric means disposed to receive light from said source and disposed so that light to the photoelectric means is blocked when a copy sheet has a portion thereof at said detecting point, and control means responsive to said photoelectric means to open said normally closed contact and to close said normally open contact of said first switch means when a portion of a copy sheet is positioned at said detecting point.

4. In an electrophotographic copying apparatus for producing images on copy sheets capable of being used in the apparatus, having a treatment zone including of a charging means for charging the copy sheet, a light-exposing means having an optical system for projecting an image of an original to be copied on the charged copy sheet thereby forming an electrostatic image on the copy sheet, a developing means for developing the exposed copy sheet thereby converting the electrostatic image into a visible image, a drying or fixing means for drying or fixing the image formed on the copy sheet, a forwarding mechanism for moving a copy sheet along a running path through the treatment zone from an initial nip to a discharge end, a copy sheet feeding mechanism for delivering single copy sheets to the initial nip of the forwarding mechanism, an original support for reciprocating the original laterally from a central position in synchronism with movement of the copy sheet and returning the original to the central position and a source of electricity, the improvement comprising:

actuating means controlling the copy sheet feeding mechanism;

first switch means having normally closed contact connecting said actuating means with a source of electricity and normally open contact;

a plurality of detecting means spaced along the running path such that the distance between successive detecting means along the running path is less than the minimum length of the copy sheets capable of being used in the apparatus, the distance between the initial nip of the forwarding mechanism and one of said detecting means along the running is less than the minimum length of a copy sheet and the distance between the discharge end of the forwarding mechanism and one of said detecting means is less than the minimum length of a copy sheet, each of said detecting means controlling said first switch means to open said normally closed contact when a copy sheet is detected thereby preventing energizing of said actuating means for the copy sheet feeding mechanism when a copy sheet is in the running path;

second switch means closed only when the original support is stationary at the central position; and alarm means connected with the source of electricity through said second switch means and said normally open contact of said first switch means, said alarm means being energized to signal occurrence of jamming of the copy sheet if the copy sheet is jammed in the running path and detected at said detecting point and closes said normally open contact of said first switch means when the original support returns to the central position and closes said second switch means.

5. The improvement as recited in claim 4 wherein each of said detecting means includes a lever movable upon contact with a copy sheet, further including a normally open switch operable to be closed by each of said levers and a relay coil connected in series with said normally open switch, said normally closed contact of said first switch means comprising a normally closed relay contact controlled by said relay coil whereby said normally closed relay contact is opened to deenergize said actuating means in response to energizing of said coil by closing said normally open switch.

6. The improvement as recited in claim 4 wherein each of said detecting means includes a source of light, photoelectric means disposed to receive light from said source and to have the light from said source blocked by a copy sheet in the running path, and further comprising control means responsive to each of said photoelectric means to open said normally closed contact of said first switch means when a copy sheet is in the running path.

7. The improvement as recited in claim 4 wherein each of said detecting means includes a normally open switch, said normally open switches being connected in parallel, and further comprising a relay coil connected in series with said normally open switches, and said normally closed contact of said first switch means comprises normally closed relay contact controlled by said relay coil whereby said normally closed relay contact is opened to deenergize said actuating means in response to energizing of said relay coil by closing of any of said normally open switches.

* * * * *

UNITED STATES PATENT OFFICE

CERTIFICATE OF CORRECTION

Patent No. 4,017,175 Dated April 12, 1977

Inventor(s) Takaji Washio, et al.

It is certified that error appears in the above-identified patent and that said Letters Patent are hereby corrected as shown below:

Claim 1, line 22, delete "activating", insert -- actuating --

Claim 1, line 43, delete "forwarding" and insert -- along the running path, --

Claim 1, line 44, delete "mechanism,"

Claim 1, line 45, delete "forwarding mechanism"

Claim 1, line 46, before ";" insert -- along the running path --

Claim 4, line 3, delete "of"

Claim 4, line 47, after "means" insert -- along the running path --

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*